US011523641B2

(12) United States Patent
Williams

(10) Patent No.: US 11,523,641 B2
(45) Date of Patent: Dec. 13, 2022

(54) LINED AND PADDED TROUSER ASSEMBLY

(71) Applicant: Frederick Williams, Mableton, GA (US)

(72) Inventor: Frederick Williams, Mableton, GA (US)

( * ) Notice: Subject to any disclaimer, the term of this patent is extended or adjusted under 35 U.S.C. 154(b) by 251 days.

(21) Appl. No.: 17/032,094

(22) Filed: Sep. 25, 2020

(65) Prior Publication Data

US 2022/0095706 A1 Mar. 31, 2022

(51) Int. Cl.

| | |
|---|---|
| ***A41D 1/08*** | (2018.01) |
| ***A41D 13/05*** | (2006.01) |
| ***A41D 1/06*** | (2006.01) |
| ***A41D 13/015*** | (2006.01) |
| ***A41D 1/089*** | (2018.01) |

(52) U.S. Cl.

CPC ..... *A41D 1/088* (2013.01); *A41D 1/065* (2013.01); *A41D 1/089* (2018.01); *A41D 13/015* (2013.01); *A41D 13/05* (2013.01)

(58) Field of Classification Search

CPC ..... A41D 1/088; A41D 1/065; A41D 1/089; A41D 13/015; A41D 13/05

See application file for complete search history.

(56) References Cited

U.S. PATENT DOCUMENTS

| | | | | | |
|---|---|---|---|---|---|
| 4,069,513 | A * | 1/1978 | Shiller | A41D 1/06 | 2/212 |
| 4,894,867 | A * | 1/1990 | Ceravolo | A41D 1/08 | 2/238 |
| 5,388,275 | A * | 2/1995 | Oram | A41D 1/088 | 2/400 |
| 5,435,014 | A * | 7/1995 | Moretz | A41B 9/12 | 2/403 |
| 5,572,737 | A * | 11/1996 | Valice | A41D 13/0575 | 2/465 |
| 5,669,902 | A * | 9/1997 | Sivilich | A61F 5/4401 | 604/385.14 |
| 6,145,132 | A * | 11/2000 | Towner | A41B 9/02 | 2/400 |
| 6,149,637 | A * | 11/2000 | Allen | A61F 13/49009 | 604/366 |
| 6,192,521 | B1 * | 2/2001 | Alberts | A41D 7/00 | 156/73.1 |
| 6,610,901 | B2 * | 8/2003 | McMahon-Ayerst | A41B 9/12 | 604/378 |
| 8,074,298 | B2 | 12/2011 | Davenport | | |
| 8,359,770 | B2 | 1/2013 | Frederick | | |
| 10,299,954 | B2 | 5/2019 | Troutner | | |
| 11,134,733 | B2 * | 10/2021 | Miller | A41B 9/001 | |

(Continued)

FOREIGN PATENT DOCUMENTS

| | | |
|---|---|---|
| WO | 2005112676 | 12/2005 |

*Primary Examiner* — Khaled Annis

(57) ABSTRACT

A lined and padded trouser assembly for cushioning a groin of a wearer includes a pair of pants having a pair of shorts positioned therein and engaged thereto. A waistband of the shorts is substantially aligned with a waistband of the pants. A pad is engaged to and positioned between the pants and the shorts so that the pad is positioned over a groin of a user upon donning the pants. The pad cushions the groin from a vertical pressure applied thereto. The shorts protect skin from chafing and absorb perspiration to prevent skin irritation.

8 Claims, 5 Drawing Sheets

(56) References Cited

U.S. PATENT DOCUMENTS

| | | | | |
|---|---|---|---|---|
| 2004/0116881 | A1* | 6/2004 | Nordness | A61F 13/496 604/358 |
| 2008/0201818 | A1* | 8/2008 | Nilforushan | A61F 7/02 2/69 |
| 2010/0095442 | A1 | 4/2010 | Kuipers | |
| 2011/0179556 | A1 | 7/2011 | partovi | |
| 2011/0265255 | A1 | 11/2011 | Hyndman | |
| 2017/0196277 | A1* | 7/2017 | Henry | A41D 13/05 |
| 2020/0397061 | A1* | 12/2020 | Jones | A41B 9/001 |

* cited by examiner

LINED AND PADDED TROUSER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to trouser assembles and more particularly pertains to a new trouser assembly for cushioning a groin of a wearer.

(2) Description of Related Art Including Information Disclosed Under 37 CFR 1.97 and 1.98

The prior art relates to trouser assemblies. Prior art trouser assemblies may comprise pants and reversibly attachable underpants, and pant having integral shock attenuators and cushioning materials.

BRIEF SUMMARY OF THE INVENTION

An embodiment of the disclosure meets the needs presented above by generally comprising a pair of pants having a pair of shorts positioned therein and engaged thereto. A waistband of the shorts is substantially aligned with a waistband of the pants. A pad is engaged to and positioned between the pants and the shorts so that the pad is positioned over a groin of a user upon donning the pants. The pad is configured to cushion the groin from a vertical pressure applied thereto. The shorts are configured to protect skin from chafing and to absorb perspiration to prevent skin irritation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
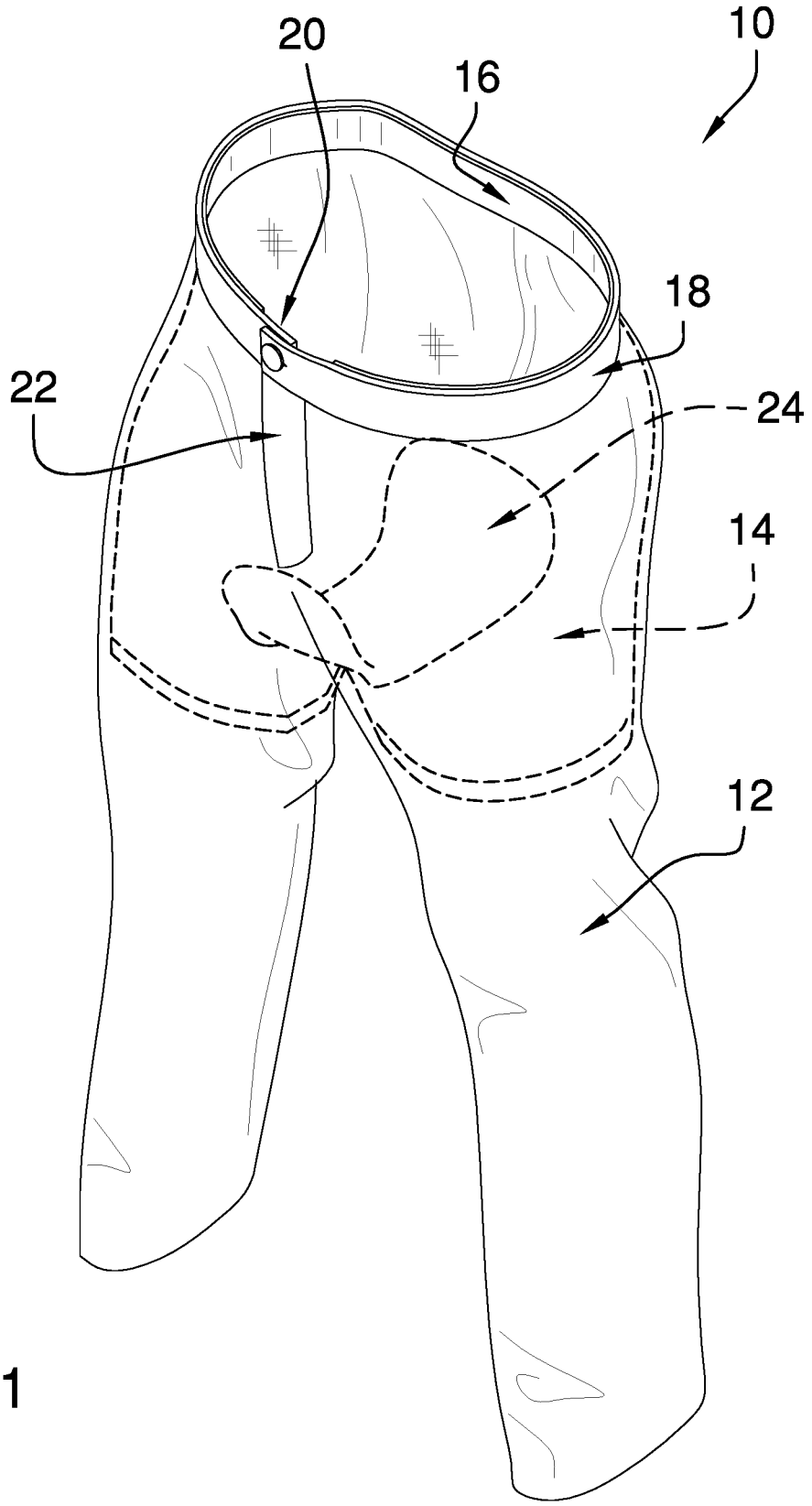
FIG. 1 is an isometric perspective view of a lined and padded trouser assembly according to an embodiment of the disclosure.
Figure 2:
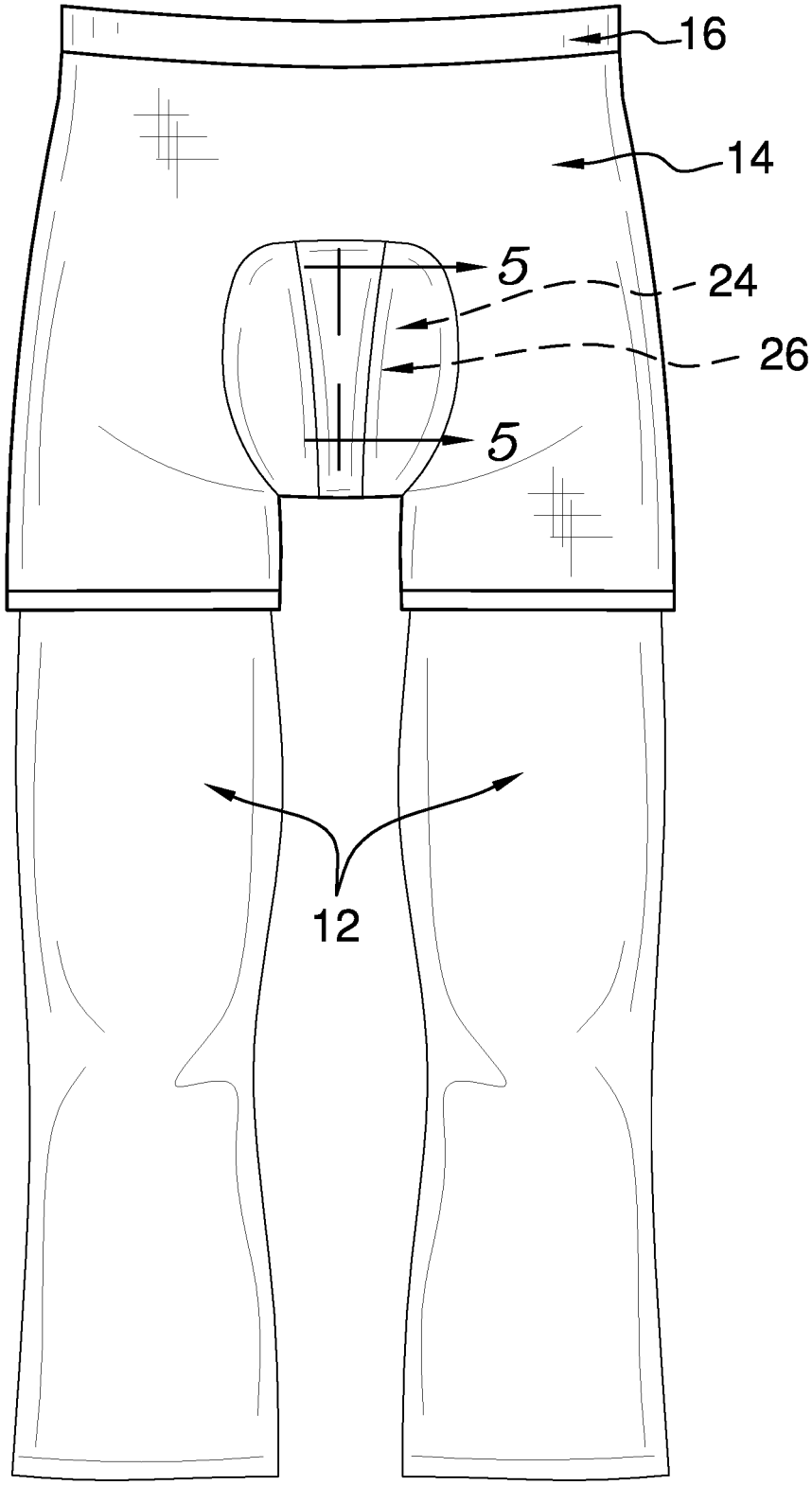
FIG. 2 is a rear inside-out view of an embodiment of the disclosure.
Figure 3:
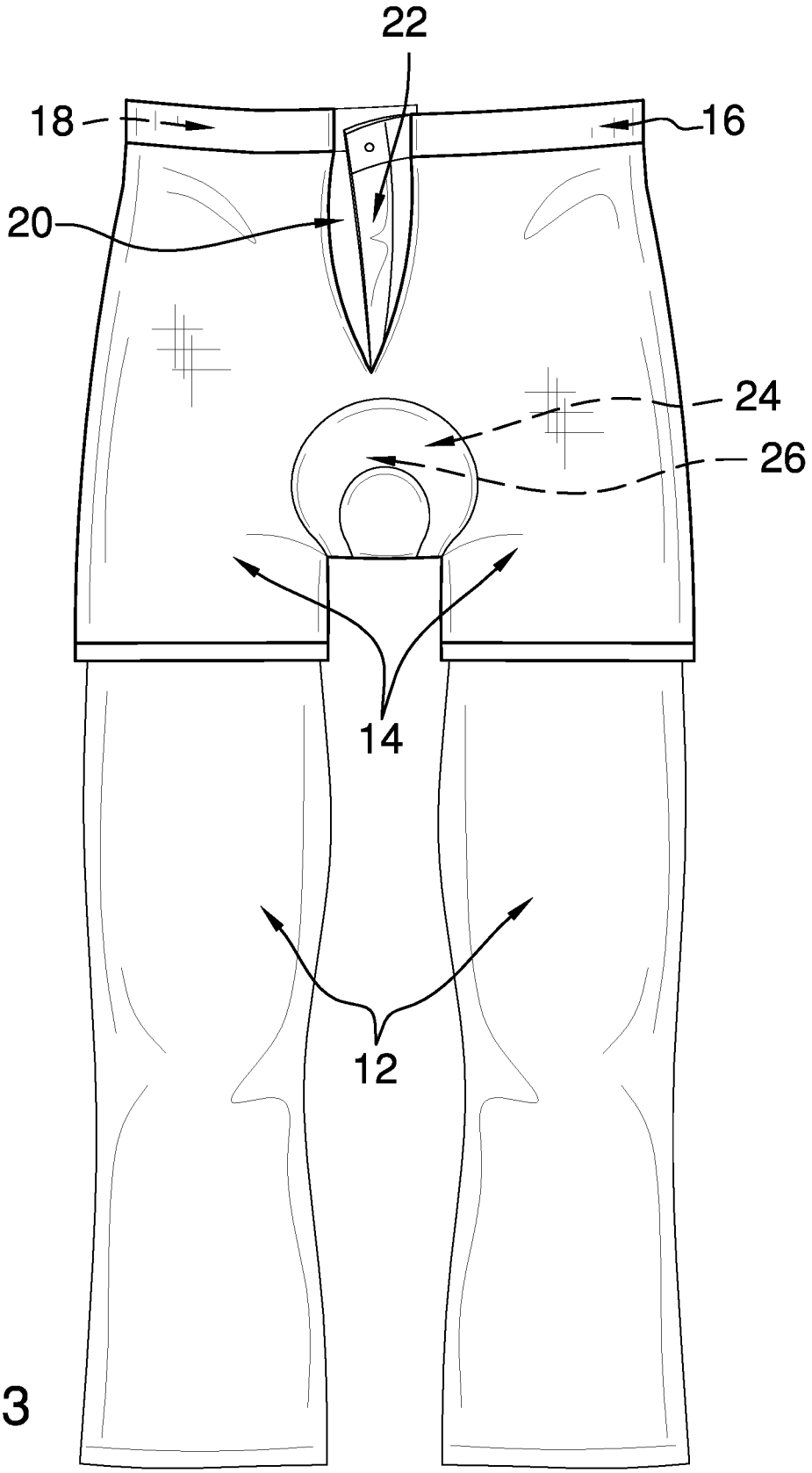
FIG. 3 is a front inside-out view of an embodiment of the disclosure.

With reference now to the drawings, and in particular to FIGS. 1 through 5 thereof, a new trouser assembly embodying the principles and concepts of an embodiment of the disclosure and generally designated by the reference numeral 10 will be described.

As best illustrated in FIGS. 1 through 5, the lined and padded trouser assembly 10 generally comprises a pair of pants 12 having a pair of shorts 14 positioned therein and engaged thereto. A waistband 16 of the shorts 14 is substantially aligned with a waistband 18 of the pants 12. The shorts 14 have a slit 20 positioned therein, which is aligned with a fly 22 of the pants 12. The pants 12 comprise denim or dungaree cloth. The shorts 14 are resiliently stretchable and comprise polyether-polyurea copolymer, 1,3-propanediol-terephthalic acid copolymer, or 1,3-propanediol-dimethyl terephthalate copolymer.

Figure 4:
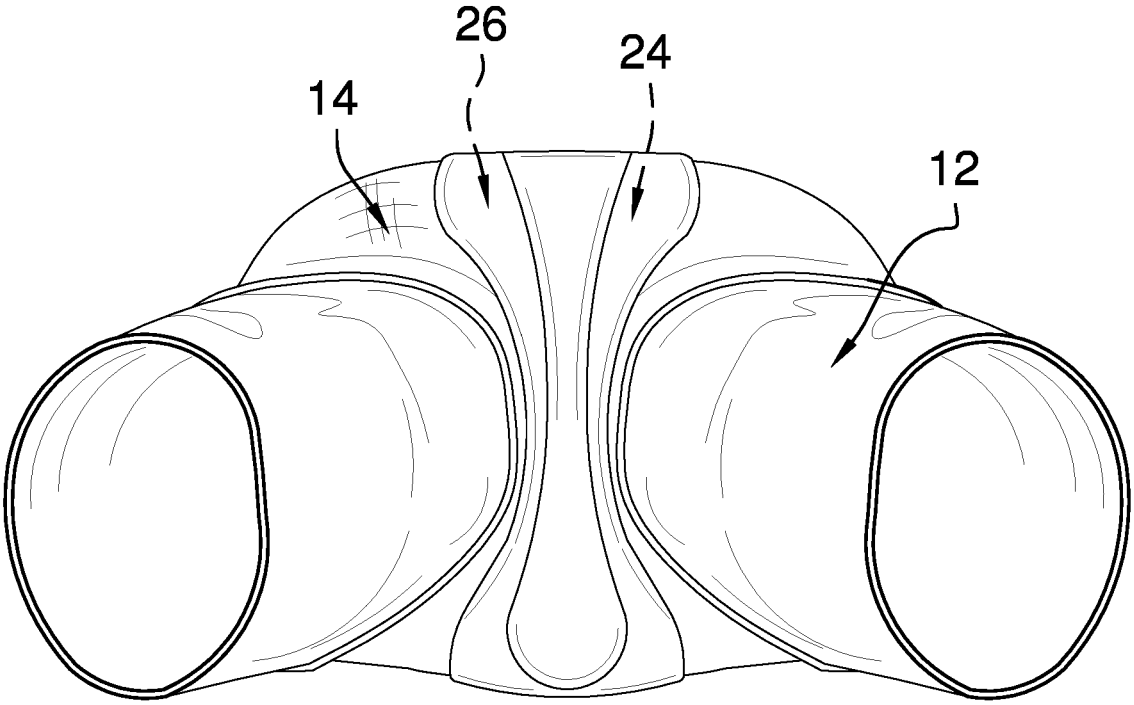
FIG. 4 is a bottom inside-out view of an embodiment of the disclosure.

A pad 24 is engaged to and positioned between the pants 12 and the shorts 14 so that the pad 24 is positioned over a groin of a user upon donning the pants 12. The pad 24 is configured to cushion the groin from a vertical pressure applied thereto. The shorts 14 are configured to protect skin from chafing and to absorb perspiration to prevent skin irritation. The pad 24 comprises gel, cotton, or foam. The pad 24 may be substantially elongated hourglass shaped, as shown in FIG. 4, or may alternatively shaped, such as, but not limited to, elongated ovally shaped, rectangularly shaped, and the like, with a limitation that the pad 24 substantially cover the groin of user upon donning the pants 12.

Figure 5:
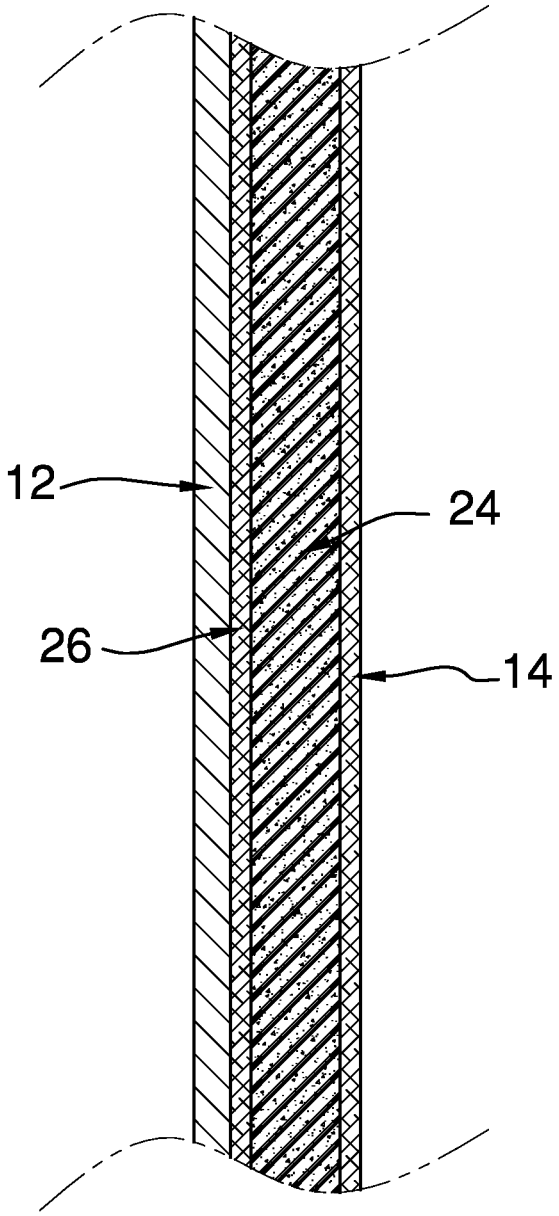
FIG. 5 is a cross-sectional view of an embodiment of the disclosure.

A liner 26 may be engaged to and positioned between the pad 24 and the pants 12, as shown in FIG. 5. The liner 26 comprises polyether-polyurea copolymer, 1,3-propanediol-terephthalic acid copolymer, or 1,3-propanediol-dimethyl terephthalate copolymer.

In use, the pants 12 are donned by the user when anticipating performance of an activity that could apply pressure to the groin of the user, such as riding of a motorcycle, bicycle, or horse. The pad 24 cushions the groin from a vertical pressure applied thereto. The shorts 14 protect skin from chafing and absorb perspiration to prevent skin irritation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A lined and padded trouser assembly comprising:

a pair of pants;

a pair of shorts positioned in and engaged to the pants such that a waistband of the shorts is substantially aligned with a waistband of the pants, wherein the shorts have a slit positioned therein and being aligned with a fly of the pants; and a pad engaged to and positioned between the pants and the shorts, such that the pad is configured to be positioned over a groin of a user upon donning the pants, wherein the pad is configured for cushioning the groin from a vertical pressure applied thereto, wherein the shorts are configured for protecting skin from chafing and for absorbing perspiration for preventing skin irritation, wherein the pad is substantially elongated hourglass shaped having a front top edge positioned spaced adjacently below the slit positioned in the shorts and the fly of the pants.

2. The lined and padded trouser assembly of claim 1, wherein the pants comprise denim or dungaree cloth.

3. The lined and padded trouser assembly of claim 1, wherein the shorts are resiliently stretchable.

4. The lined and padded trouser assembly of claim 3, wherein the shorts comprise polyether-polyurea copolymer, 1,3-propanediol-terephthalic acid copolymer, or 1,3-propanediol-dimethyl terephthalate copolymer.

5. The lined and padded trouser assembly of claim 1, wherein the pad comprises gel, cotton, or foam.

6. The lined and padded trouser assembly of claim 1, further including a liner engaged to and positioned between the pad and the pants.

7. The lined and padded trouser assembly of claim 6, wherein the liner comprises polyether-polyurea copolymer, 1,3-propanediol-terephthalic acid copolymer, or 1,3-propanediol-dimethyl terephthalate copolymer.

8. A lined and padded trouser assembly comprising:

a pair of pants, the pants comprising denim or dungaree cloth;

a pair of shorts positioned in and engaged to the pants such that a waistband of the shorts is substantially aligned with a waistband of the pants, the shorts having a slit positioned therein and being aligned with a fly of the pants, the shorts being resiliently stretchable, the shorts comprising polyether-polyurea copolymer, 1,3-propanediol-terephthalic acid copolymer, or 1,3-propanediol-dimethyl terephthalate copolymer;

a pad engaged to and positioned between the pants and the shorts, such that the pad is configured to be positioned over a groin of a user upon donning the pants, wherein the pad is configured for cushioning the groin from a vertical pressure applied thereto, wherein the shorts are configured for protecting skin from chafing and for absorbing perspiration for preventing skin irritation, the pad comprising gel, cotton, or foam, the pad being substantially elongated hourglass shaped having a front top edge positioned spaced adjacently below the slit positioned in the shorts and the fly of the pants; and a liner engaged to and positioned between the pad and the pants, the liner comprising polyether-polyurea copolymer, 1,3-propanediol-terephthalic acid copolymer, or 1,3-propanediol-dimethyl terephthalate copolymer.

* * * * *